US005702527A

United States Patent [19]

Seaver et al.

[11] Patent Number: 5,702,527

[45] Date of Patent: Dec. 30, 1997

[54] RESTRICTED FLOW DIE

[75] Inventors: Albert E. Seaver, Woodbury; Lyle N. Scheel; Luther E. Erickson, both of Stillwater; Daniel R. Danielson, Lake St. Croix Beach, all of Minn.

[73] Assignee: Minnesota Mining and Manufacturing Company, St. Paul, Minn.

[21] Appl. No.: 392,108

[22] Filed: Feb. 22, 1995

[51] Int. Cl.[6] ..... B05D 1/04

[52] U.S. Cl. ..... 118/410; 118/300

[58] Field of Search ..... 118/410, 300, 118/400

[56] References Cited

U.S. PATENT DOCUMENTS

| | | | |
|---|---|---|---|
| 402,188 | 4/1889 | Peregrine . | |
| 3,171,820 | 3/1965 | Volz | 260/2.5 |
| 3,352,802 | 11/1967 | Powers | 260/2.5 |
| 3,365,325 | 1/1968 | Fraenkel et al. | 117/105.3 |
| 3,828,725 | 8/1974 | Lewicki, Jr. . | |
| 4,489,671 | 12/1984 | Choinski . | |
| 5,234,330 | 8/1993 | Billow et al. . | |
| 5,326,598 | 7/1994 | Seaver et al. | 427/423 |

FOREIGN PATENT DOCUMENTS

| | | |
|---|---|---|
| 6000436 | 1/1994 | Japan . |
| 895535 | 1/1982 | U.S.S.R. . |

*Primary Examiner*—Lyle A. Alexander

*Attorney, Agent, or Firm*—Gary L. Griswold; Walter N. Kirn; Charles D. Levine

[57] ABSTRACT

A coating device has a first half and a second half located adjacent the first half to form a slot between the first and second halves. A porous material, having a thickness greater than the height of the slot, is disposed in the slot to compress uniformly along its width. The porous material has a porosity and a height selected in combination with each other to create a predetermined pressure drop through the slot and to maintain the pressure drop to create the desired flow rate along the slot width. The size of the pores in the porous material can be less than 25 μm and the exit pressure drop through the slot can be at least one thousand times greater than could be obtained without the porous material.

17 Claims, 3 Drawing Sheets

RESTRICTED FLOW DIE

TECHNICAL FIELD

The present invention relates to coating dies. More particularly, the present invention relates to coating dies with improved pressure drops through the exit slot.

BACKGROUND OF THE INVENTION

Passing a fluid through a porous object during flow of the fluid is known. U.S. Pat. No. 402,188 discloses a painting apparatus in which the paint passes through a porous stainer. Compressing the stainer reduces the flow of paint or stain through it. U.S. Pat. No. 3,828,725 describes a curtain coater in which an open-celled material or a plurality of spheres is placed in the cavity above the slot to reduce the flow. U.S. Pat. No. 3,365,325 discloses curtain coating through one or more porous members.

In coating using a slot die, it is desirable to have the fluid flow out of the slot be as uniform as possible to maintain coating uniformity. If the pressure drop in the slot is much larger than the pressure drop along the manifold (or distribution chamber), then the variation of pressure in the manifold will not drastically affect the uniformity of the flow out of the slot. The standard method to accomplish a uniform flow out of the slot is to make the pressure drop in the slot large compared to the pressure drop in the manifold. This is done by making the slot gap height very small. This is relatively simple and works well for metal dies where the dimensional stability of the die is good.

However, even for a metal die, when coating low flow rate, low viscosity liquids at uniform high pressure drops, the slot gap height required can become so small that the slot gap tolerance becomes a major cause of pressure drop variation in the die. Even worse, some dies are made of nonconductive plastic because they are good electrical insulators. These dies can be used as electrospray slot and wire coating dies, such as disclosed in U.S. Pat. No. 5,326,598. Plastics are not nearly as dimensionally stable as metal and do not machine as accurately, reducing the ability to create an accurate slot. As the die width is increased to accommodate wider webs, the possibility of a slot variation along the die width increases due to the poor dimensional stability. Again, this is important when coating low flow rate, low viscosity fluids when uniformly high pressure drops are desired.

It is important that coating dies deliver the proper crossweb uniformity of liquid flow. Inadequate uniformity, especially with ultra-thin film coatings can lead to loss of full coating coverage. At very low flow rates and low viscosities, the slot gap height and height tolerance required to meet the crossweb uniformity requirements in metal and especially in non-metal plastic dies are not feasible.

It is difficult to achieve good crossweb uniformity in a coating die at low viscosities and low flow rates. With some coating dies, a 6 mil slot gap height achieves good crossweb uniformity. The pressure drop is directly proportional to the slot length. Because the local flow rate at a given pressure is a function of the cube of the slot gap height, a small variation in slot gap height can have a dramatic impact on crossweb uniformity. (Throughout this description, the slot gap height is the gap, w, which determines the thickness of fluid leaving the slot and moving toward the coating web; the slot width, W, is perpendicular to the gap height and to the downstream direction, and determines the width of the fluid coating on the web; and the slot length, L, is the distance from the exit edge of the distribution cavity or manifold to the slot exit.)

U.S. Pat. No. 4,489,671 discloses that a precisely cut porous plug can be located in a die slot to increase the pressure drop when coating thin coatings of solvent or aqueous compositions such as colloids and other fluids having suspended solid particles floating within them. These coatings have a continuous phase which evaporates to create the thin coatings, enabling the wet coating thickness to be much greater than the final dry coating thickness. This patent fails to address the need to improve pressure drops in slot dies when coating solventless inviscid fluids, particularly liquids where little or no evaporation occurs.

Solventless liquid coatings, which tend to be oligomeric solutions, have low viscosities, typically in the range of 1 to 100 mPa-s. Because they also have essentially no evaporating phase, the wet and dry thicknesses of the coating are essentially the same, and these liquids are required to move at low flow rates in a coating die. These low viscosity liquids exhibit low pressure drops when transported. To coat these fluids through slot dies, it is necessary to coat through small die slot gap heights to achieve the necessary flow rates and still create sufficiently high pressure drops. In using such small slot gap heights, even small machining variations in making the die are critical and can create serious flow rate variances across the die width. There is a need for a system to coat uniformly low flow rate liquids through a slot at a sufficiently high pressure drop.

SUMMARY OF THE INVENTION

This invention is a coating device having a first half and a second half located adjacent the first half to form a slot between the first and second halves. The slot has a length and extends to the end of the coating device to form an exit having an exit area defined by a slot gap height and a slot width. A porous material, having a thickness greater than the height of the slot gap, is disposed in the slot to be compressed uniformly along its width. The porous material has a porosity and a length selected in combination with each other to create a predetermined pressure drop through the slot at a specified low flow rate and to maintain the pressure drop to create the desired flow rate profile along the slot width.

The coating device can be a coating die with two die halves forming a manifold from which the slot extends. The porous material can be located between the slot exit and the manifold and can have its exit end located even with the slot exit, recessed from the exit, or extended from the exit, depending upon the coating application.

The size of the pores in the porous material can be less than 25 μm and the exit pressure drop through the slot can be at least one thousand times greater than could be obtained without the porous material. In one embodiment, the end of the porous material closer to the slot exit can be concave.

The invention also includes a method of coating a fluid through a slot having a porous material in the slot.

DETAILED DESCRIPTION

In the design of coating dies, it is important that the die deliver the proper crossweb uniformity of liquid flow. At very low flow rates and low viscosities, the slot gap height must be extremely narrow and the gap height tolerance required to meet the crossweb flow rate uniformity requirement in both metal and plastic dies is not feasible.

At very low flow rates, this invention overcomes the highly non-uniform flow rate problem that occurs with known dies by placing, under a slight compression, a thin strip of small void volume, open cell, porous plastic material or other similar material in the die slot. The uniformity of the cell size creates the desired back pressure and uniform crossweb flow distribution. Selecting a small void volume for the porous strip creates the necessary pressure drop through the die. If a nonuniform distribution across the width of the die is desired, the strip could be cut to a nonuniform length for the desired effect. The insertion of the small void volume porous material in the die slot allows the slot gap height to be much larger than would be required without the material. This allows standard machining practices to create a die that can operate at low flow rates with good uniformity.

Figure 1:
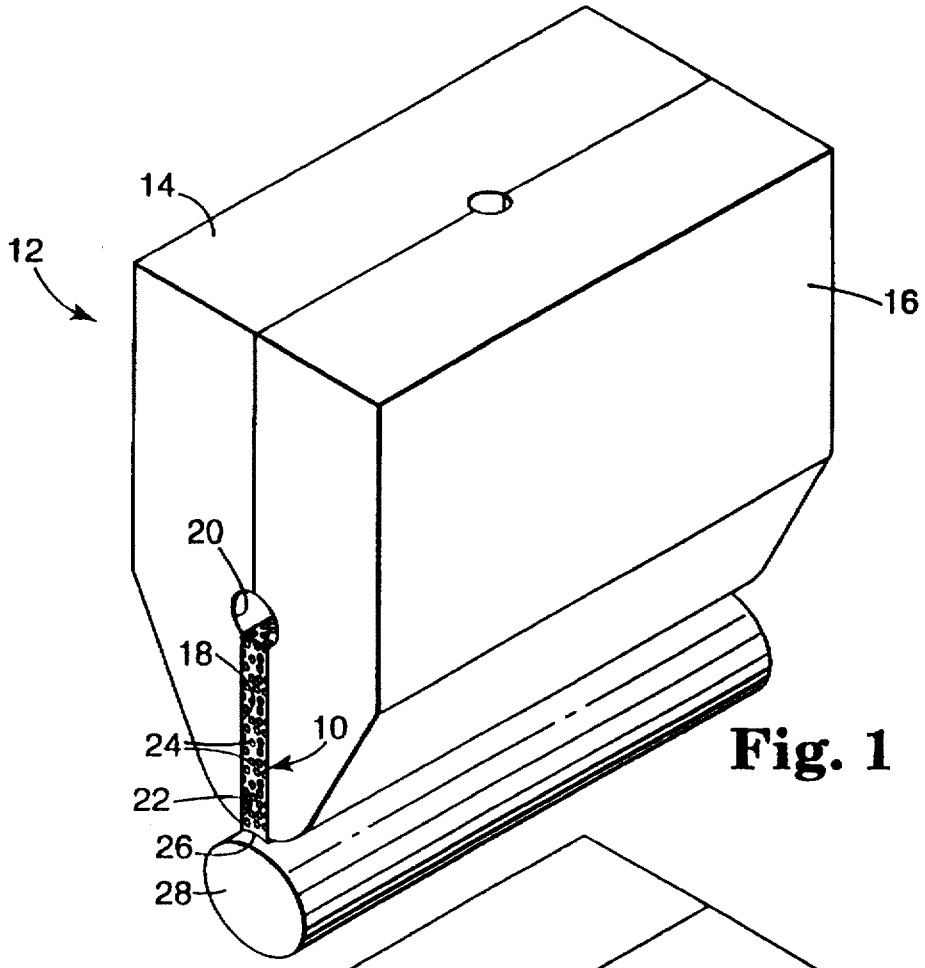
FIG. 1 is a schematic view of the restricted flow die of the present invention.
Figure 3:
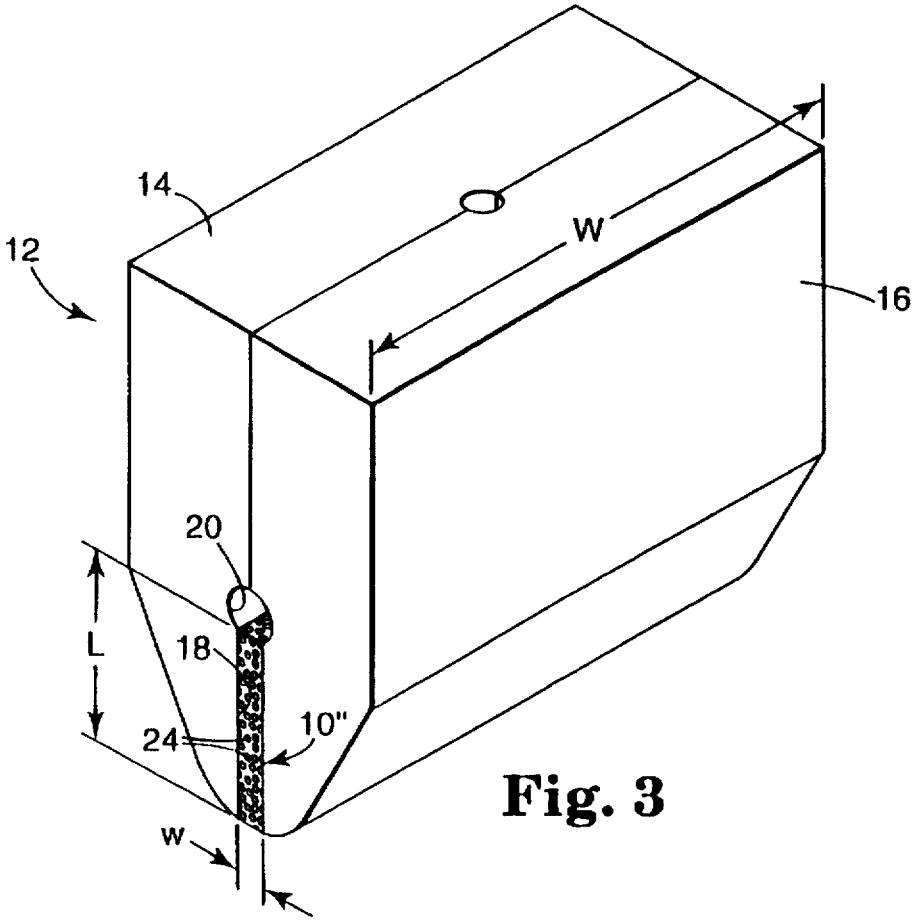
FIG. 3 is a schematic view of the restricted flow die according to another embodiment of the present invention.

Referring to FIG. 1, the porous strip 10 is used in a coating device such as a slot die. A slot coating die 12 typically has a first half 14 and a second half 16 located adjacent the first half 14 to form a slot 18 between the two halves. End plates (not shown) are fastened to each end of the die 12 and prevent the coating liquid from flowing out of the ends of the die. A manifold 20 is formed in the die 12 and the slot 18 extends to the end of the die 12 from the manifold 20. The die slot 18 terminates in an exit 22 and has an exit area defined by the product of the slot gap height w and the slot width W, shown in FIG. 3.

Figure 4:
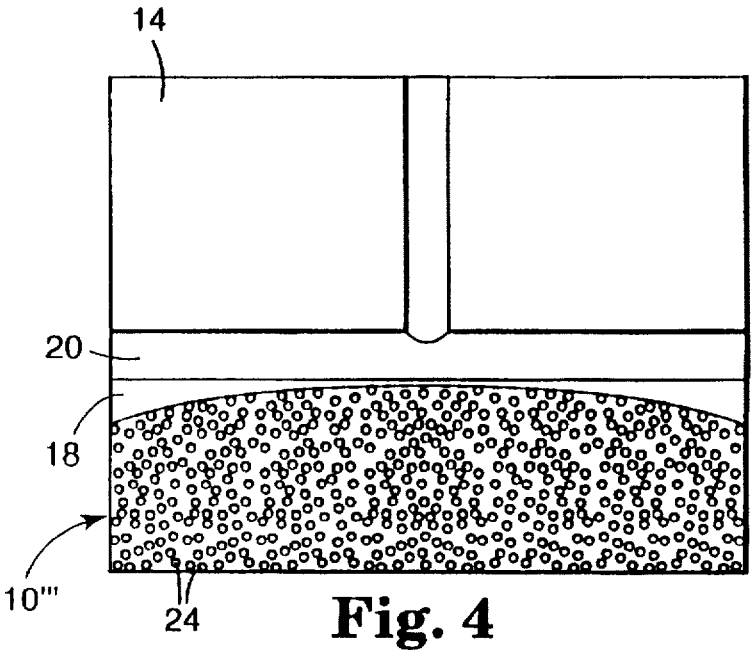
FIG. 4 is a side view of the restricted flow die according to another embodiment of the present invention.

The length of the porous strip 10 can be substantially equal to the length of the slot and the strip, and before being placed in the die, should have a thickness t greater than the slot gap height w of the slot. When the porous strip 10 is disposed in the slot 18, the slot compresses the material uniformly along its thickness. The strip 10 has a porosity and a length selected in combination with each other to create, at a defined flow rate, a predetermined pressure drop through the slot 18 and to maintain the pressure drop uniformly along the slot width so that a uniform flow rate occurs within the slot. The strip 10, assuming a constant thickness, determines the pressure drop for a fluid at a given viscosity when the coating weight and web speed define the required flow rate. However, if the pressure drop in the manifold 20 is not uniform, the length of the porous strip 10'" can be varied along the die width to create a pressure drop variation that maintains a uniform flow rate, as shown in FIG. 4. In this situation, and in other situations, the manifold end of the porous strip 10 is not even with the manifold-slot junction. It could be in the slot 18 spaced from the manifold 20 or it can extend into the manifold 20.

Figure 2:
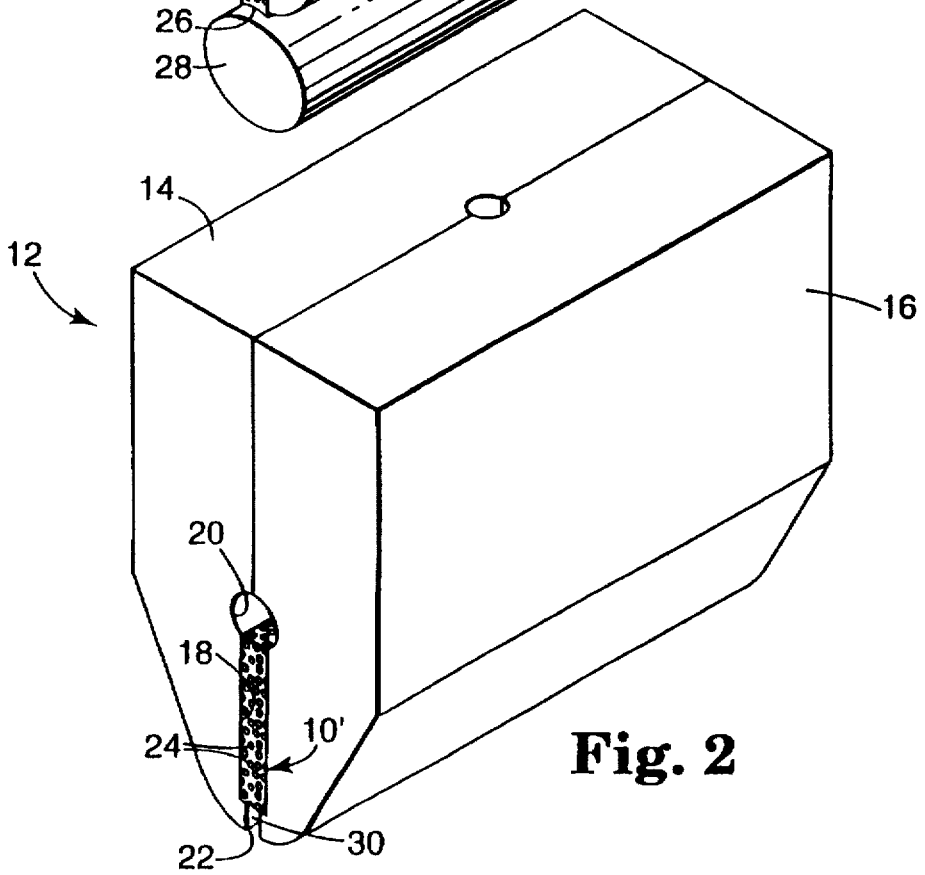
FIG. 2 is a schematic view of the restricted flow die according to another embodiment of the present invention.

The porous strip 10 is located in the slot 18 between the manifold 20 and the slot exit 22. The strip 10 can be located extended beyond the slot exit (FIG. 1), the strip 10' can be recessed from the slot exit, such as by less than 4 mm (FIG. 2) where a final exit slot 30 is created, or the strip 10" can be even with the slot exit (FIG. 3), depending on the application. Also, the strip 10 need not extend all the way to the manifold 20. Preferably, the size of the pores 24 in the strip 10 is less than 25 micrometers (μm) and ranges from 10 to 20 m. In using the porous strip 10, the exit pressure drop attained is at least one thousand times greater, and can be ten thousand or more times greater than could be obtained without the porous strip. Put another way, the slot 18 is at least ten times wider (and can be twenty to thirty times wider) than is usable without a porous strip to achieve the same pressure drop for a fixed viscosity liquid issuing at a fixed flow rate.

As shown in FIG. 1, the end of the strip of porous material closer to the slot exit can be concave 26 and can be shaped to match that of an adjacent object 28, such as a small radius wire in a slot and wire die coater, or a larger radius web which is contoured by and is passing over a roller. In this embodiment, the strip allows further control of the liquid between the die slot exit and the adjacent object 28.

The pressure drop in the die slot can be modeled using the equation which describes the flow through a slot. When a porous strip, which, when compressed, has the dimensions of the slot and has a void volume fraction of α, is inserted into a slot of a cross-sectional area defined by a slot width W, a slot gap height w, and a slot length L, the flow rate Q per unit width W of the slot gap is defined by equation (1):

$$q=Q/W=(P_o-P_L)w^3/(12\,\mu L R_\alpha) \quad (1)$$

where $P_o$ is the pressure at the inlet, $P_L$ is the pressure at the outlet (a distance L from the inlet so that $P_o-P_L$ is the pressure drop along the flow length L), and μ is the viscosity of the fluid. $R_\alpha$ is the relative resistance to liquid flow that increases the pressure drop across the strip as the void volume decreases. (The void volume is a product of the pore sizes and the number of pores in the strip.) $R_\alpha$ can be calculated by a conservation of void volume equation, as defined by equation (2):

$$R_\alpha-1/[1-(1-\alpha)^{1/3}]^3 \quad (2)$$

where $R_\alpha$ is a dimensionless number. For example, a void volume of about 27% yields a pressure drop of about one thousand times greater than the pressure drop obtainable without the porous material.

Providing a uniform pressure drop by inserting a strip of porous material into the die slot enables a wider die slot to be used so that machining tolerances are less important. A fine porous polyethylene material (sheet grade, X-4920, X-tra Fine PE) made by Porex Technologies of Fairburn, Ga. and similar materials can be used. The thickness of X-4920 is approximately 1.59 mm (0.0625 in) and it has a 10–20 μm pore size. For example, with a 19.05 mm (0.75 in) length strip clamped in a 317.5 mm wide die slot, the back pressure reached 6.97 kPa for a total flow rate of 15.1 cc/min (which is a volumetric flow rate of 0.48 cc/min per cm of die width). In several experiments, the use of this material enabled attaining uniform flow rates.

Several positions can be used for the bottom of the strip. In one experiment, the strip was machined with a concave radius in the tip and positioned with the radius contacting and partially surrounding an adjacent object. In other trials, the strip was even with the slot exit at the die tip or recessed inside the die tip. Preferably, the die slot gap height can be machined to slightly less than the thickness of the strip to provide a slight compression of the material and better sealing. This compression is preferably uniform. A very thin coating of an inert adhesive can be smeared along the slot walls to hold the strip in position and to prevent any slight thickness non-uniformities of the strip, which could create a local area with a strip thickness less than the slot gap height, from impairing flow uniformity.

Figure 6:
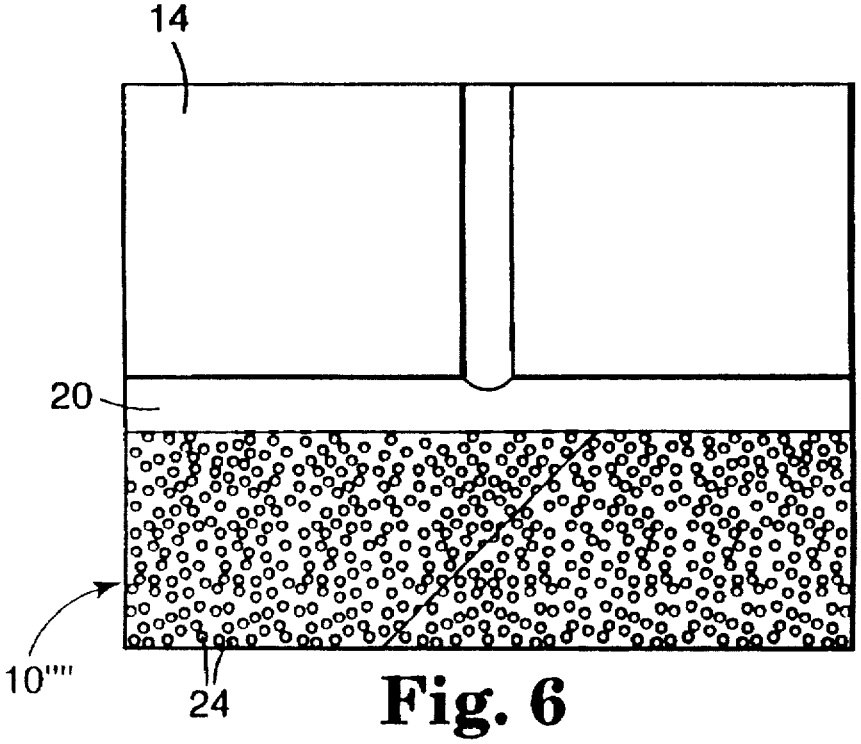
FIG. 6 is a side view of the restricted flow die according to another embodiment of the present invention.

If the porous strip 10 is not available in sizes wide enough for wider production dies without a joint, to attain the desired flow uniformity in the joint area, two strips can be made using special jigs. For example, the first jig cuts a uniform 19.05 mm (0.75 in) strip 10"" of the porous membrane insert, allowing a uniform pressure drop along the membrane. The second jig cuts a compound bevel on the end of each piece. When properly assembled, the joint area flow rate is the same as the surrounding area as detected by the visual uniformity of the liquid filament spacing when the die is operated as an electrospray slot and wire die. Preferably, adjacent strips 10"" are not cut with 90° sides but with angled, such as 45°, sides to distribute any membrane abutment error between the adjacent strips over a greater width of the die, as shown in FIG. 6.

EXAMPLE

An example of the improvements achieved by this invention is as follows. Consider coating a liquid known as ATC-1. This liquid includes a UV curable release polymer (UV9300 epoxysilicone made by GE Silicones, Waterford, N.Y.) in a solution of UV curable diluents plus photoinitiator. The diluents are 1,4-cyclohexanedimethanol divinyl ether (RapiCure CHVE Reactive Diluent by GAF Chemicals Corporation, Wayne, N.J.), limonene monoxide (LO, from Atochem, Philadelphia, Pa.), and d-limonene (L, from Florida Chemical Co., Inc., Lake Alfred, Fla.). The initiator is an iodonium salt (UV9310C or UV9380C by GE Silicones). The solution is designated by GE9300/CHVE/LO/L+UV9310C and the weight mixture is designated by the series of numbers 40/20/15/25+3, which means 40% GE9300, 20% CHVE, 15% LO, 25% L, and 3 pph GE9310. The sum of all four chemistries is 100%. The photoinitiator is added by a weight in parts per hundred (pph) to the final mixture. The fluid properties of ATC-1 are: the electrical conductivity is 9.94 μS/m; the dielectric constant is 7.3; the surface tension is 23 mN/m; the viscosity is 10.5 mPa-s; and the density is 920 kg/m$^3$.

A 33 cm (13 in) slot and wire die was used. The die had a 31.8 cm (12.5 in) slot and two 6.35 mm (0.25 in) end plates. The die had a die manifold with a bore inner diameter of 9.53 mm, and a width of 31.8 cm (12.5 in). The exit slot had a width of 31.8 cm (12.5 in), a gap height of 1.53 mm (60 mil), and a length of 19.05 mm (0.75 in).

The slot gap machine tolerance is 0.0127 mm (0.5 mil), so the slot gap variation is only ±1.7% and the flow rate variation across the die slot is only ±5%. Unfortunately, when coating 1 μm wet coatings at a web speed of 45.7 m/min (150 ft/min), the pressure drop for the ATC-1 solution is only 0.53 Pa (about 0.002 inches of water). This back pressure is too low to maintain control of the fluid. If on the other hand, a 6.4 kPa pressure drop is desired, the slot gap height must be only 0.066 mm (2.6 mil). For a 0.0127 mm (0.5 mil) machine tolerance, this slot gap height would have a crossweb variation of almost 40%. The result would be an unacceptable flow rate uniformity across the die. Hence, the known slot coating dies are incapable of coating low viscosity liquids as uniformly thin coatings at low flow rates.

To achieve the necessary pressure drop, a strip, such as a 1.59 mm thick Porex X-4920 filter, having an apparent void volume after compression of 12.5% was used. This filter was compressed to the 1.53 mm height of the slot gap. (Porex Technologies claims that their porous sheet grades have an average mean pore size in the 10–150 micron range with void volumes of 35–50%. The sheet grade is shipped in 106.7 cm (42 in) by 111.8 cm (44 in) sheets. The extra fine grade X-4920 should have the lowest porosity.) The Porex X-4920 filter was recessed by 3.18 mm (0.125 in) from the slot exit and the die was machined to create a 0.508 mm (0.02 in) final exit slot gap. The final exit slot 30 (shown generally in FIG. 2) had a gap thickness of 0.508 mm, and a height of 3.18 mm. By placing this strip in the slot 18, a pressure of 6.4 kPa was achieved with a flow rate of 0.457 cc/min per cm of die width (the conditions used to coat a 1 μm wet coating at a web speed of 45.7 m/min) while maintaining a ±1.7% slot gap variation across the die. The porous strip allowed the pressure to be held at a reasonable value while maintaining a ±5% uniformity of the flow across the die due to the machining tolerance. The porous strip allows the pressure to be held at a reasonable value while maintaining the uniformity of the pressure and hence the flow across the die.

Figure 5:
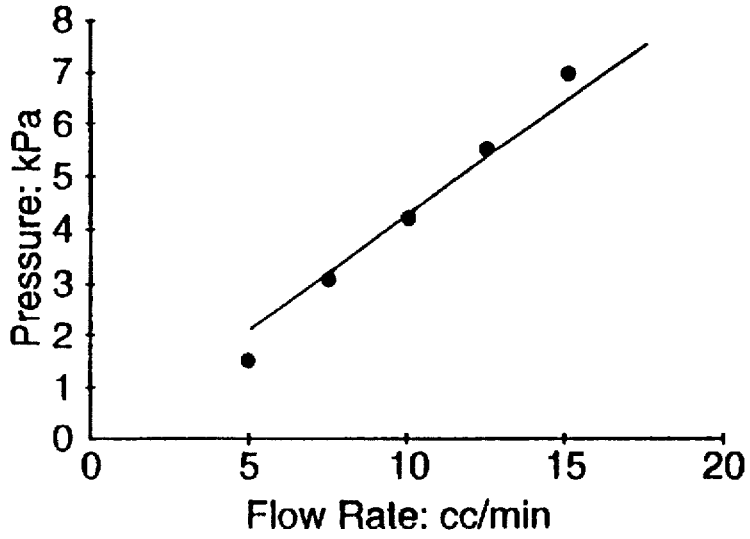
FIG. 5 is a graph of a back pressure versus flow rate curve for the invention of FIG. 1.

After the compression of the Porex strip, the void volume was calculated at 12.5%. Selecting this small void volume for the porous strip creates a reasonable pressure drop through the die, as shown in a back pressure versus flow rate curve of FIG. 5. The solid line is the calculated pressure drop based on the void volume of 12.5% (relative resistance of 12120) and the dots are the actual data points.

This invention has been described for use with slot dies. It is effective with metal dies, although one particular need is with plastic dies. It can be used with any type of slot coater and has particular use with electrospray coating like slot and wire coaters, such as disclosed in U.S. Pat. No. 5,326,598. However, as conventional slot dies are applied to thin solventless coatings which require low flow rates, the use of the low void volume porous strip will allow crossweb flow rate uniformity, eliminating this difficulty from the coating operation.

We claim:

1. A coating device comprising:

a first half;

a second half located adjacent the first half to form a slot between the first and second halves, wherein the slot has a length and extends to the ends of the coating device to form an exit having an exit area defined by a slot gap height and a slot width; and means for creating a controlled predetermined pressure drop through the slot and for maintaining the pressure drop through the slot at a defined flow rate to create the defined flow rate along the slot width, wherein the creating and maintaining means comprises a porous material having an uncompressed thickness greater than the gap height of the slot, disposed in the slot to compress uniformly along its width to a thickness substantially equal to the gap height of the slot, and having a porosity and a length selected in combination with each other to create when compressed the controlled predetermined pressure drop.

2. The coating device of claim 1 which is a coating die.

3. The coating device of claim 2 wherein the die halves form a manifold from which the slot extends, and wherein the porous material is located between the slot exit and the manifold.

4. The coating device of claim 3 wherein an end of the porous material is located at the junction of the slot and the manifold.

5. The coating device of claim 3 wherein an end of the porous material is located even with the slot exit.

6. The coating device of claim 3 wherein an end of the porous material is recessed from the slot exit.

7. The coating device of claim 3 wherein the slot exit is not critical to the compression of the porous material and has a stepped slot gap height that differs from the remainder of the slot.

8. The coating device of claim 3 wherein the porous material is recessed from the slot exit and the slot comprises a final slot exit which has a stepped slot gap height that is less than that of the remainder of the slot which receives the porous material.

9. The coating device of claim 1 wherein the size of the pores in the porous material is less than 25 m and the void volume is less than 27%.

10. The coating device of claim 1 wherein the exit pressure drop through the slot is at least one thousand times greater than could be obtained without the porous material.

11. The coating device of claim 10 wherein the exit pressure drop through the slot is at least ten thousand times greater than could be obtained without the porous material.

12. The coating device of claim 1 wherein the end of the porous material closer to the slot exit is concave.

13. The coating device of claim 1 wherein the width of the porous material is at least substantially equal to the width of the slot.

14. The coating device of claim 1 wherein the length of the porous material is varied along the die width to create a pressure drop variation that maintains a uniform flow rate.

15. The coating device of claim 1 wherein the porous material comprises a plurality of adjacent strips which extend for a total length substantially equal to the length of the slot, wherein the adjacent sides of adjacent strips are non-parallel to the flow direction in the slot to distribute any membrane abutment error between the adjacent strips over a greater width of the die.

16. The coating device of claim 15 wherein the adjacent sides of adjacent strips are angled at 45° to the flow direction in the slot.

17. A coating die comprising:

a first half;

a second half located adjacent the first half to form a manifold and a slot between the first and second halves, wherein the slot extends from the manifold to the ends of the coating device to form an exit having an exit area defined by a slot gap height and a slot width; and means for creating a controlled predetermined pressure drop through the slot and for maintaining the pressure drop through the slot at a defined flow rate to create the desired flow rate along the slot width, wherein the creating and maintaining means comprises a porous material having an uncompressed thickness greater than the gap height of the slot, disposed in the slot between the slot exit and the manifold to compress uniformly along its width to a thickness substantially equal to the height of the slot, and having a porosity and a length selected in combination with each other to create when compressed the controlled predetermined pressure drop, wherein the size of the pores in the porous material is less than 25 μm, wherein the exit pressure drop attained is at least one thousand times greater than could be obtained without the porous material.

* * * * *

UNITED STATES PATENT AND TRADEMARK OFFICE

CERTIFICATE OF CORRECTION

PATENT NO.: 5,702,527

DATED: Dec. 30, 1997

INVENTOR(S): Albert E. Seaver, et al.

It is certified that error appears in the above-identified patent and that said Letters Patent is hereby corrected as shown below:

Column 7, Line 7 Delete "25 m" and insert in place thereof - - 25 μm - -

Signed and Sealed this

Thirteenth Day of October 1998

*Attest:*

Bruce Lehman

BRUCE LEHMAN

*Attesting Officer*

*Commissioner of Patents and Trademarks*